United States Patent [19]

Bradd et al.

[11] Patent Number: 5,014,385

[45] Date of Patent: May 14, 1991

[54] CLEANER CORD WRAP

[75] Inventors: Sidney H. Bradd, Solon; Richard R. Tucker, Canton, both of Ohio

[73] Assignee: The Hoover Company, North Canton, Ohio

[21] Appl. No.: 451,616

[22] Filed: Dec. 18, 1989

[51] Int. Cl.[5] ..... A47L 5/36

[52] U.S. Cl. ..... 15/323; 15/339

[58] Field of Search ..... 15/323, 339, 410

[56] References Cited

U.S. PATENT DOCUMENTS

| | | | |
|---|---|---|---|
| 2,291,353 | 7/1942 | Seyfried . | |
| 2,321,222 | 6/1943 | Lofgren . | |
| 2,418,130 | 4/1947 | Lofgren . | |
| 2,653,342 | 9/1953 | Bonin et al. . | |
| 2,693,001 | 11/1954 | Vance | 15/410 X |
| 2,974,343 | 3/1961 | Seyfried | 15/323 |
| 3,170,184 | 2/1965 | Jepson et al. | 15/323 |
| 4,658,465 | 4/1987 | Keane et al. | 15/323 |
| 4,720,890 | 1/1988 | Jacob | 15/323 |
| 4,809,393 | 3/1989 | Goodrich et al. | 15/323 |

FOREIGN PATENT DOCUMENTS

| | | | |
|---|---|---|---|
| 125309 | 6/1949 | Sweden | 15/323 |
| 244023 | 8/1946 | Switzerland | 15/323 |

*Primary Examiner*—Chris K. Moore

[57] ABSTRACT

A cleaner is shown having a cord wrapped around a switch operating pedal with the operating pedal always being in a protective position over the switch.

7 Claims, 4 Drawing Sheets

CLEANER CORD WRAP

BACKGROUND OF THE INVENTION

1. Field of the Invention

This invention relates to floor care appliances and, more specifically, to a canister cleaner having an electrical cord.

2. Summary of the Prior Art

The use of cord wraps for the storage of electrical cord on cleaners is old and well known. Specifically on canister cleaners, cord wraps have been maintained in coiled position on these cleaners, for example, by being wrapped around the canister cleaner handle or around the canister cleaner support means or a combination of the handle and support means. Cord wraps on canister cleaners, for convenience sake, have even been formed adjacent the on-off switch for the cleaner or have utilized an on-off switch operating means for holding one end of the coiled hank on the cleaner to obtain both convenience and dual functioning. However, although such a dual functioning is advantageous, it is not known heretofore that this dual functioning has been provided in a switch operating means where the switch, itself, was always shielded from the cord. Then no damage could occur to it due to the cord or some other object being disposed against or around it when the cord wrap was in released position.

Accordingly, it is an object of the invention to provide a switch and switch operating means for a cleaner where, when the cord wrap is in released position relative to the switch operating means, the switch is shielded.

It is an additional object of the invention to provide a new and improved switch and cord retaining switch operating means arrangement in a cleaner.

It is a still further object of the invention to provide an improved cord coiling arrangement for a vacuum cleaner.

SUMMARY OF THE INVENTION

The invention comprehends the use of a cord wrap disposed around a mounting arrangement on a canister cleaner. The mounting arrangement includes a detented hook like element on one side of the top of the cleaner which mounts one side of the hank of the wrapped cord. The other side of the hank is mounted on a switch actuating means on the other side of the top of the canister cleaner. The rear side of the cord is captured beneath a lip formed integrally in the cleaner shell. Thus, the cord is wrapped between these three elements.

The detented hook like element pivots on generally vertical axis and mounts the cord on a portion extending vertically axially relative to this vertical axis. A horizontal extension of the hook like element holds the cord on the vertically extending portion. A detent maintains the hook like element with the horizontal extension disposed in an outwardly pointed direction to maintain the hank end of the cord on it. To release the cord, the detent is overcome and the hook like element pivoted on its vertical axis until the horizontal extension points inwardly.

The switch actuating means also includes a horizontally extending portion and a vertical axial portion to provide a functional hook for the side of the hank of coiled cord. It is mounted for reciprocal movement vertically into and out of the canister cleaner. Disposed beneath it in a sheltered position within a well for the canister cleaner is an on-off switch for the cleaner.

BRIEF DESCRIPTION OF THE DRAWINGS

Reference may now be had to the accompanying Drawings for a better understanding of the invention, both as to its organization and function, with the illustration being of a preferred embodiment, but being only exemplary, and in which.

DETAILED DESCRIPTION OF THE INVENTION

Figure 1:
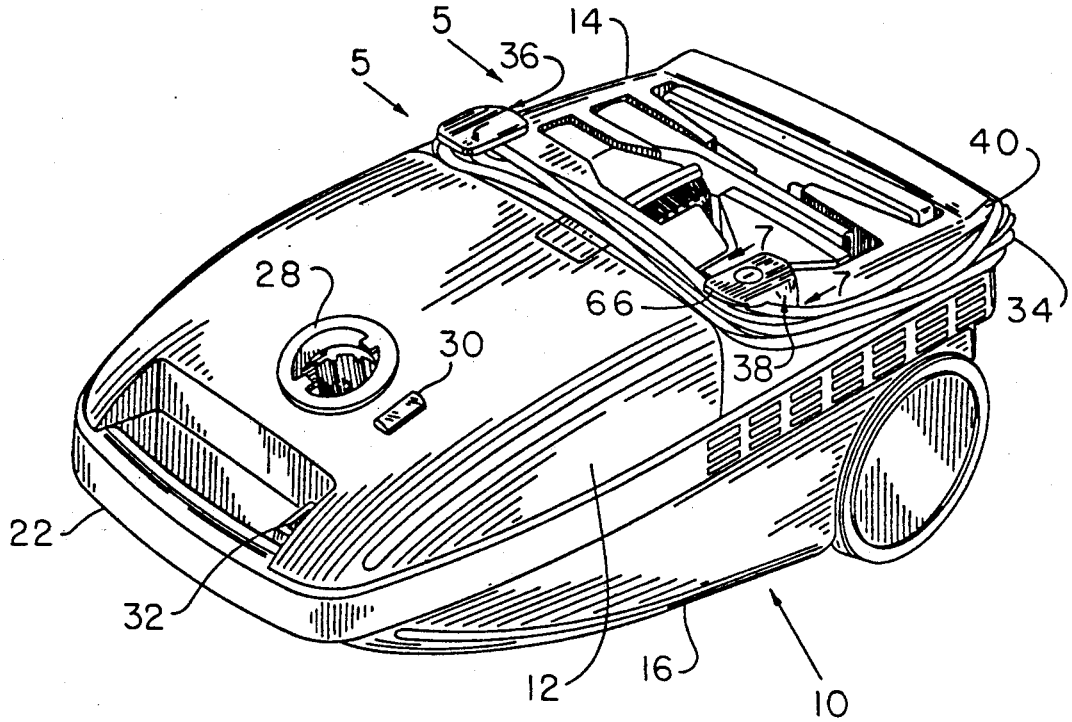
FIG. 1 is a perspective view of a cleaner incorporating the invention with the cord wrapped.
Figure 2:
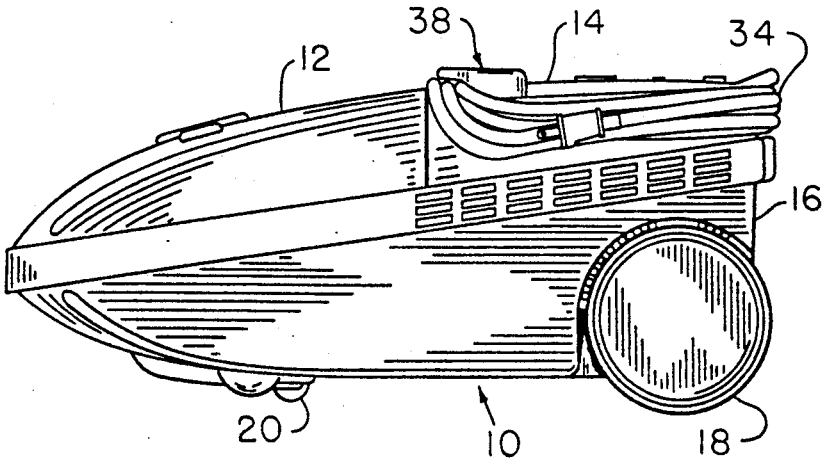
FIG. 2 is a side elevation view of this cleaner with the cord wrapped.
Figure 3:
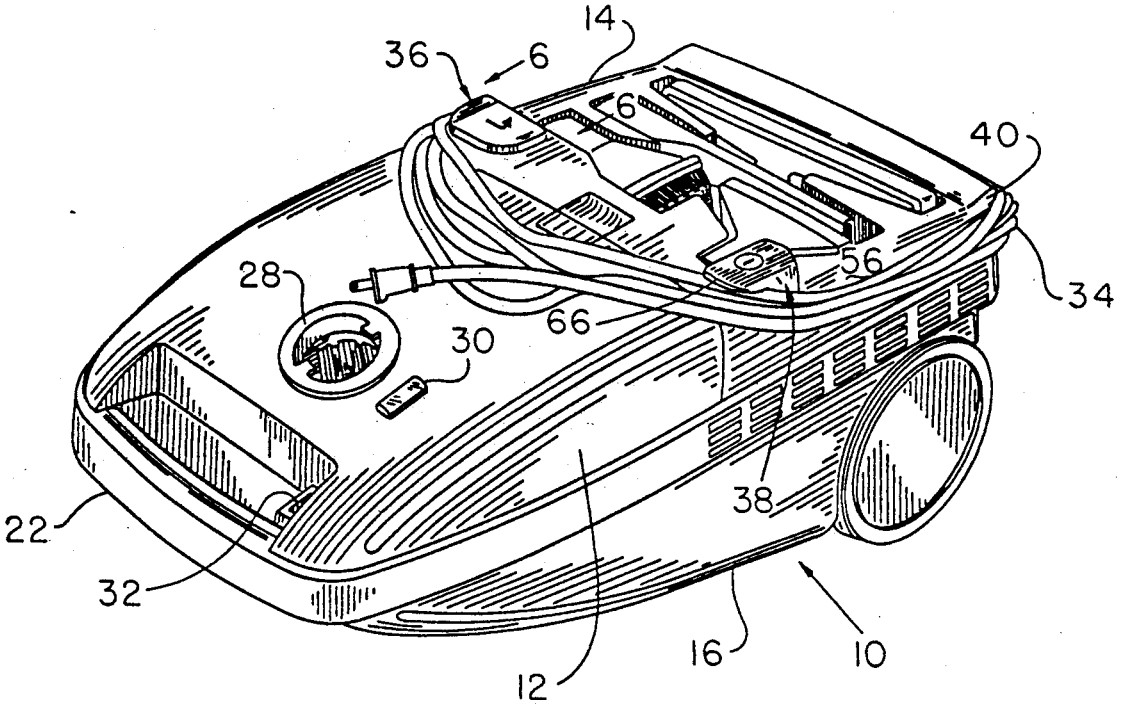
FIG. 3 is a perspective view of the cleaner with the cord released.
Figure 4:
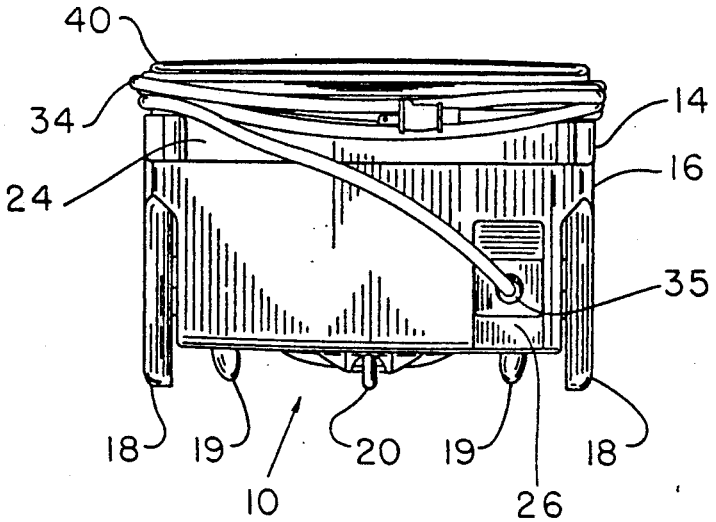
FIG. 4 is a rear view of the cleaner with the cord wrapped.
Figure 5:
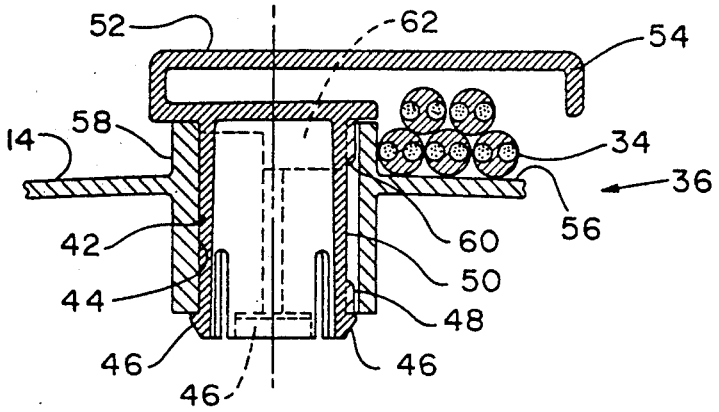
FIG. 5 is a cross sectional view of the cord retaining and release means in cord retaining position taken looking in the direction of line 5—5 of FIG. 1.
Figure 6:
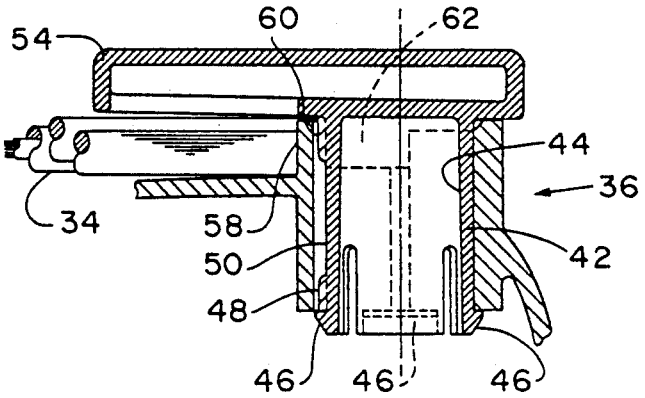
FIG. 6 is a cross sectional view of the cord retaining and release means in released position and taken in the direction of line 6—6 of FIG. 3.
Figure 8:
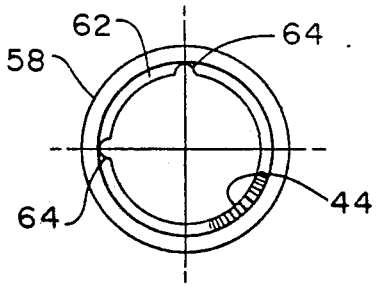
FIG. 8 is a plan view of the bore in the tool storage and motor cover which mounts the cord retaining and release means.
Figure 9:
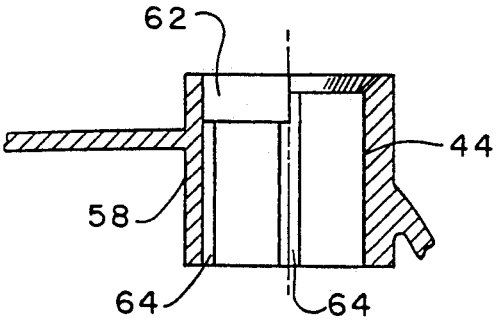
FIG. 9 is a sectional view through this bore.
Figure 7:
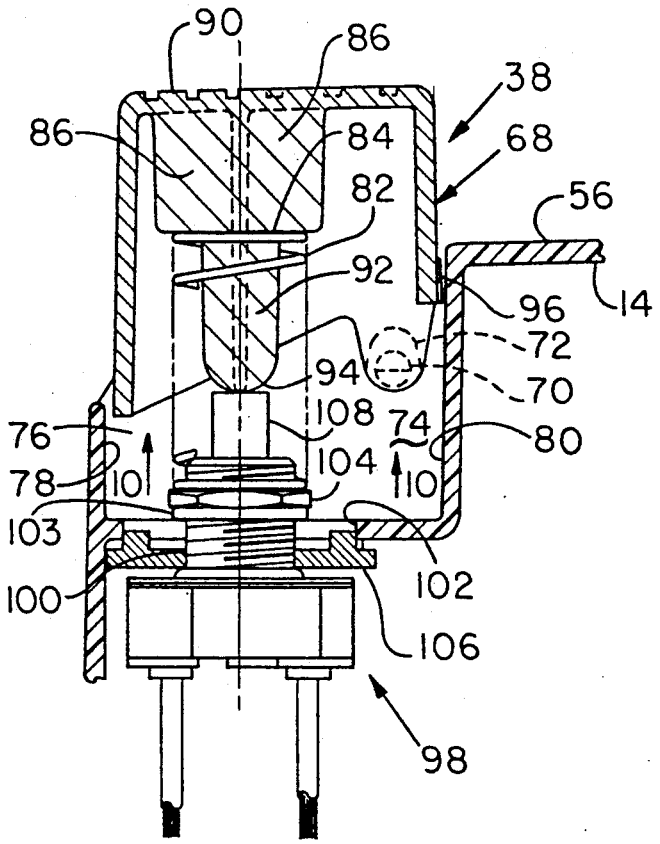
FIG. 7 is a cross section of the switch and switch actuating mechanism taken on line 7—7 of FIG. 1 and showing the switch disposed in its well.
Figure 10:
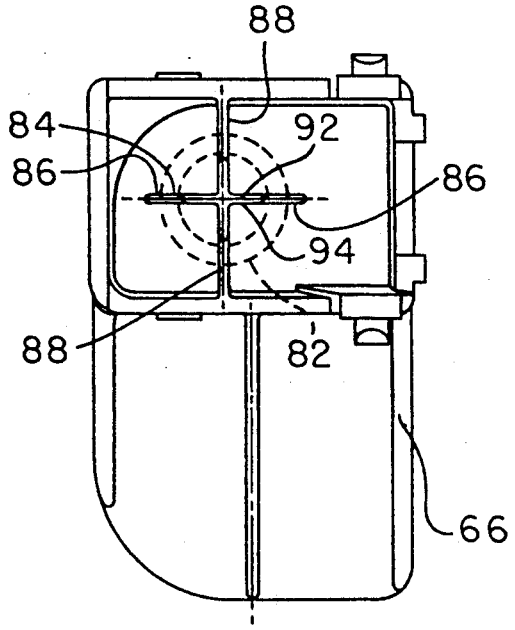
FIG. 10 is a bottom plan view of the switch operating means.

In the Drawings can be seen a vacuum cleaner 10 which includes a bag lid 12, a tool storage and motor cover 14 and a bottom 16 that form the general outline of the cleaner 10. The cleaner 10 is supported on rear wheels 18, 18 ribs 19, 19 and a front caster 20. A handle 22 is disposed at the cleaner front, while the tool storage and motor cover 14 and the bottom shell 16 form rear portions 24 and 26, respectively, of the cleaner 10. A suction port 28 is formed in the front portions of bag lid 12 for the conventional connection of a suction hose (not shown) to be utilized with the cleaner 10. A full bag indicator 30 and a female socket 32 for connection to a cord extending to a power nozzle (not shown) is also included.

A cord 34 passing through aperture 35 in rear side 26 of bottom shell 16 is provided for connection to cleaner 10. It may be coiled tightly around a cord release or dump means 36 and a switch operating means 38 both, disposed at the front portion and each on a side of the tool storage and motor cover 14, and a fixed lip means 40 formed integrally along the upper rear side 24 of tool storage and motor cover 14.

The cord dump or release means 36 (FIGS. 5, 6, 8 and 9) includes a hollow shaft portion 42 that depends downwardly in a bore 44 formed integrally in the upper side of tool storage and motor cover 14 and is held rotatably in this bore by a series of four one way locking barbs 46, 46, 46 (only three shown) formed on the end of hollow shaft portion 42. The hollow shaft portion 42 also includes a semi-cylindrical dimple 48 formed immediately above one of the locking barbs 46 which extends generally outwardly of the general surface 50 of hollow shaft 42 to form a detent to lockingly arrest the rotation of cord dump 36. This structure will be described later.

Above the hollow shaft portion 42 of cord dump means 36 is disposed a transverse portion 52 that is integral with and extends transversely of the hollow shaft portion 42. This transverse portion includes an extending end 54 beneath which the cord 34 is disposed when the cord dump 36 is in the position illustrated in FIGS. 1 and 5. The cord 34, in this position, also tends to lay on a top surface 56 of tool storage and motor cover 14. A cylindrical portion 58 of tool storage and motor cover 14 extends above the surface 56 to extend the bore 44 and to space the extending end 54 of cord dump means 36 above the surface 34 to provide a volume in which cord 34 can be coilingly stored.

Within the upper portion of bore 44, formed by cylindrical portion 58, hollow shaft 42 includes an integrally formed radially outwardly extending semi-cylindrical dimple 60. This dimple serves as a stop means to limit movement of cord dump means 36 to approximately a 90° arc. The cord dump means 36 is limited to this range of rotation by the dimple 60 being disposed in an outward step 62 of bore 44 disposed in an upper part of this bore. The outward step 62 comprises a swept arc of the desired range of 90°, with this arc having a thickness of the radial projection of dimple 60 and being centered on the axial center of bore 44. The dimple 60 then can rotatably ride in the step 62 between its terminations because the dimple 60 has an axial length slightly less than the height of the outward step 62.

The first mentioned dimple 48, at the same time, serves as a locking means at the extremes of cord dump rotation by being received in semi cylindrical grooves 64, 64 formed on the outer periphery of bore 44 and extending vertically axially along and radially outwardly from it. The dimple 60 similarly is received at the ends of the outward step at these limits of travel of the cord dump means 36. The dimple 48 when in an undetented state is compressingly received in bore 44 with the hollow shaft 42, discontinuous in this area, deforming to permit the easy rotation of this dimple between the semi cylindrical grooves 64, 64. The dimple 60 must be disposed in a discontinuity formed by outward step 62 between the cylindrical grooves 64, 64 to allow the cord dump means 36 to rotate because the hollow shaft 42 is relatively undeformable adjacent its connection to transverse portion 52 of cord dump means 36.

The switch operating means 38 includes a transverse ribbed portion 66 spaced from the top surface 56 of tool storage and motor cover 14 for the retention of cord 34. This transverse portion merges integrally with a stub portion 68 that extends vertically downwardly from the transverse portion and is pivotally attached to tool storage and motor cover 14. The stub portion 68 is generally rectangular in cross section. A pair of sidewardly extending cylindrical lugs 70, 70 (only one shown) integral with stub portion 68 are snapfit mounted in elliptical bores 72, 72 (only one shown) in tool storage and motor cover 14 to provide for this pivoting and limited vertical movement.

The elliptical bores 72, 72 are formed in a pair of opposed side walls 74, 74 (only one shown) of a well 76, also rectangular in cross section and including opposed walls 78, 80 adjoining walls 74, 74. The well 76 is thereby of a closed configuration formed by walls 74, 74 (only one shown) and the walls 78 and 80 and formed integrally in tool storage and motor cover 14.

The switch operating means 38, through its stub portion 68 is resiliently urged upwardly by a compression spring 82 that abuts upwardly against an upper spring seat 84 formed by an integral group of four supporting legs 86, 86, 88, and 88 extending downwardly and inwardly from an integral top surface panel 90 of the stub portion 68. These four legs are formed in plan view in a cross pattern and all terminate downwardly at the same level. A projecting section 92, extending from and integral with the terminating lower border of legs 86, 86 and having a non spring interfering domed end 94 serves as a guide means for compression spring 82.

Since the compression spring 82 tends to urge the stub portion 68 of switch operating means 38 pivotally about pivot lugs 70, 70 outwardly of the well 76 a pair of stops 96, 96 (only one shown) are formed on stub portion 68 to extend outwardly therefrom. These stops engage against opposed wall 80 of well 76 and limited this pivoted movement so that switch operating means 38 is always disposed within well 76 during operation of the cleaner 10.

A switch 98 is disposed within the vacuum cleaner 10 below switch operating means 38 so that it is protected by the switch operating means 38 and tool storage and motor cover 14 at all times. This switch can be any conventional push-push switch so that the pivotal and slightly reciprocal movement of switch operating means 38 may initiate on and off action of it. Conveniently the switch 98 may include a threaded cylindrical upper portion 100 that may extend through an aperture 102 in tool storage and motor cover 14 so that a washer 103 may be disposed over and a fastening nut 104 may be screwed down on the edges of the aperture 102 to captivate the switch 98 in the vacuum cleaner 10.

A spacer 106, fitting partly inside the aperture 102, may insure that an operating plunger 108 of switch 98 is disposed at a proper height for operation by the domed end 94 of switch operating means 38. The spring 82 abuts compressingly downwardly against the fastening nut 104. The structure of the switch 98 and switch operating means 38 is now complete so that it fixed relative to the switch operating means 38 and can be turned on and off by it.

It should be clear that a cleaner has been described having all the advantages set out at the beginning portion of this Specification. It should also appear that many modifications could be made to the description offered that would obviously fall within its spirit and purview.

What is claimed is:

1. A cord wrap arrangement for storing cord on a canister cleaner including;

(a) a switch for initiating at least one mode of operation of said canister cleaner, (b) said switch being disposed generally within a shell of said canister cleaner, (c) a manually operated pedal for operation of said switch at least partially extending away from said shell, (d) said manually operated pedal utilized as a hook means for winding said stored cord, (e) said manually operated pedal being disposed in covering relationship to said switch at all times to thereby protect said switch from structural harm.

2. The cord wrap arrangement of claim 1 wherein;

(a) another hook means is disposed on a side of said canister cleaner opposite to said pedal;

(b) said another hook means also mounting said wrapped stored cord;

(c) said another hook means including a boss and being pivotally mounted to said canister cleaner to be pivotable to release said cord and to act as a cord dump for said wrapped cord.

3. The cord wrap arrangement of claim 2 wherein;

(a) said cord wrap is also maintained by being disposed around rear portions of said canister cleaner.

4. The cord wrap arrangement of claim 3 wherein; (a) said cord wrap is maintained around rear portions of said cleaner by an extending lip formed in said cleaner.

5. A cord wrap arrangement for a cleaner including;

(a) a switch mounted on said cleaner, (b) a manually actuated switch operating means for initiation of said switch disposed on said cleaner, (c) said manually actuated switch operating means including means serving as a hook for said cord wrap, (d) another hook for said cord wrap spaced on said cleaner from said manually operated switch operating means, and (e) said another hook serving as a cord dump for said cord wrap arrangement.

6. The cord wrap arrangement of claim 5 wherein;

(a) said manually operated switch actuating means is disposed over said switch at all times to prevent said switch from damage.

7. The cord wrap arrangement of claim 6 wherein;

(a) said another hook is pivoted to provide said cord dump.

* * * * *